US008642906B2

(12) United States Patent
Yeon

(10) Patent No.: US 8,642,906 B2
(45) Date of Patent: Feb. 4, 2014

(54) RELAY FOR ELECTRIC VEHICLE

(75) Inventor: Young Myoung Yeon, Chungcheongbuk-Do (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 201 days.

(21) Appl. No.: 13/274,234

(22) Filed: Oct. 14, 2011

(65) Prior Publication Data

US 2012/0091103 A1 Apr. 19, 2012

(30) Foreign Application Priority Data

Oct. 15, 2010 (KR) ..... 10-2010-0100781

(51) Int. Cl.
*H01H 3/46* (2006.01)

(52) U.S. Cl.
USPC ..... 200/430; 335/78

(58) Field of Classification Search
USPC ..... 200/430, 153; 335/78–86, 121
See application file for complete search history.

(56) References Cited

U.S. PATENT DOCUMENTS

| | | | | |
|---|---|---|---|---|
| 3,344,253 | A | 9/1967 | Roessler et al. | |
| 3,604,875 | A * | 9/1971 | Walters et al. | 200/430 |
| 4,039,984 | A | 8/1977 | DeLucia et al. | |
| 4,310,818 | A * | 1/1982 | Essler et al. | 335/135 |
| 4,404,533 | A | 9/1983 | Kurihara et al. | |
| 4,978,935 | A * | 12/1990 | Hoffman et al. | 335/121 |
| 5,099,091 | A * | 3/1992 | Kokubu | 200/5 B |
| 6,075,429 | A * | 6/2000 | Uotome et al. | 335/78 |
| 6,265,955 | B1 * | 7/2001 | Molyneux et al. | 335/128 |
| 7,868,720 | B2 * | 1/2011 | Bush et al. | 335/151 |
| 2002/0145494 | A1 | 10/2002 | Andoh et al. | |

FOREIGN PATENT DOCUMENTS

| | | |
|---|---|---|
| CN | 101167151 | 4/2008 |
| CN | 101261909 | 9/2008 |
| DE | 2353444 | 6/1975 |
| EP | 1953784 | 8/2008 |
| JP | 1167039 | 3/1999 |
| JP | 11-232986 | 8/1999 |
| JP | 2002-042625 | 2/2002 |
| JP | 2004355847 | 12/2004 |
| JP | 2006-019148 | 1/2006 |
| JP | 2007287525 | 11/2007 |
| JP | 2010-10059 | 1/2010 |
| JP | 201020959 | 1/2010 |
| WO | 2011/115049 | 9/2011 |

OTHER PUBLICATIONS

European Patent Office Application No. 11184309.0, Search Report dated Sep. 17, 2012, 7 pages.
Japan Patent Office Application No. 2011-226045, Office Action dated Dec. 4, 2012, 3 pages.

(Continued)

*Primary Examiner* — Truc Nguyen
(74) *Attorney, Agent, or Firm* — Lee, Hong, Degerman, Kang & Waimey

(57) ABSTRACT

Disclosed is a relay for an electric vehicle capable of guiding a precise assembly of a cover assembly and a supporting plate. The supporting plate comprises a position guiding portion protruding from an upper surface thereof so as to guide the cover assembly to be located on a predetermined position of the supporting plate when assembling the cover assembly and the supporting plate to each other.

6 Claims, 3 Drawing Sheets

(56) References Cited

OTHER PUBLICATIONS

Japan Patent Office Application No. 2011-226045, Office Action dated May 14, 2013, 3 pages.

Japan Patent Office Application Serial No. 2011-226045, Notice of Allowance dated Aug. 27, 2013, 1 page.

The State Intellectual Property Office of the People's Republic of China Application Serial No. 201110319630.1, Office Action dated Nov. 20, 2013, 6 pages.

* cited by examiner

RELAY FOR ELECTRIC VEHICLE

CROSS-REFERENCE TO RELATED APPLICATION

Pursuant to 35 U.S.C. §119(a), this application claims the benefit of earlier filing date and right of priority to Korean Patent Application No. 10-2010-0100781, filed on Oct. 15, 2010, the contents of which are incorporated by reference herein in their entirety.

BACKGROUND OF THE INVENTION

1. Field of the Invention

This specification relates to a relay for an electric vehicle, and particularly, to a relay for an electric vehicle capable of opening or closing an electric power supply circuit installed at an electric vehicle and connected to a motor.

2. Background of the Invention

An electric vehicle may include a battery-only electric vehicle using only power charged at a battery, a hybrid vehicle using an electric power charged at a battery and/or a fossil fuel, a fuel cell vehicle, an electric golf cart and an electric fork lift. A relay for the electric vehicle is installed between a battery and an inverter, and serves to supply the electric power from the battery to the inverter, or to break the electric power supply to the inverter from the battery. Here, the inverter is a means to convert a direct current (DC) of the battery into an alternating current (AC), and to supply the converted AC to an AC motor configured to drive a vehicle.

The relay for an electric vehicle largely comprises a fixed contact, a movable contact movable to contact or be separated from the fixed contact, and an actuator for diving the movable contact. The fixed contact and the movable contact are accommodated in an arc extinguishing chamber. The arc extinguishing chamber is formed in an assembly implemented as an upside down cup-shaped ceramic cover is coupled to a supporting plate formed of a metallic material. The arc extinguishing chamber is sealed after extinguishing gas is filled therein, the extinguishing gas for extinguishing an arc generated when the fixed contact and the movable contact are separated from each other. The fixed contact is installation-supported at the ceramic cover, and the actuator is installation-supported at the supporting plate.

A metal connecting member is attached to an end of the ceramic cover. As the metal connecting member is adhered to the supporting plate by welding, implemented is an assembly of the air sealed-ceramic cover and the supporting plate.

In the conventional art, when the supporting plate and the metal connecting member are adhered to each other by welding for an assembly of the ceramic cover and the supporting plate to each other, a welding jig is used to fix the ceramic cover to a precise position.

However, the conventional relay for an electric vehicle may have the following disadvantages.

In a process of precisely positioning the metal connecting member coupled to the ceramic cover onto the supporting plate and then fixing them to each other by the welding jig, the assembly of the ceramic cover and the metal connecting member may be mal-aligned on the supporting plate with rotation. The reason is because the assembly is positioned on a flat upper surface of the supporting plate so as to be freely movable. That is, it is difficult to precisely align the assembly of the ceramic cover and the metal connecting member on the supporting plate when fixing the assembly onto the supporting plate by welding. Furthermore, when the assembly is fixed onto the supporting plate by welding at an imprecise position due to rotation, not a precise position, a welding quality may be degraded, and a horizontal position deviation may occur between the fixed contact and the movable contact. This may cause the occurrence of inferiority when the movable contact comes in contact with the fixed contact, and may lower the reliability of the relay for an electric vehicle.

SUMMARY OF THE INVENTION

Therefore, an aspect of the detailed description is to provide a relay for an electric vehicle capable of guiding a precise assembly of a cover assembly and a supporting plate.

To achieve these and other advantages and in accordance with the purpose of this specification, as embodied and broadly described herein, there is provided a relay for an electric vehicle, comprising: a fixed contact; a movable contact movable to contact or be separated from the fixed contact; an actuator configured to drive the movable contact so as to contact or separate the movable contact to or from the fixed contact; a supporting plate configured to support the actuator; and a cover assembly configured to support the fixed contact, and fixed on the supporting plate so as to form an arc extinguishing chamber which accommodates therein the fixed contact and the movable contact, wherein the supporting plate has a position guiding portion protruding from an upper surface thereof that guides the cover assembly to be located on a predetermined position of the supporting plate and maintains the assembled position of the cover assembly and the supporting plate when assembling the cover assembly and the supporting plate to each other.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings.

Figure 1:
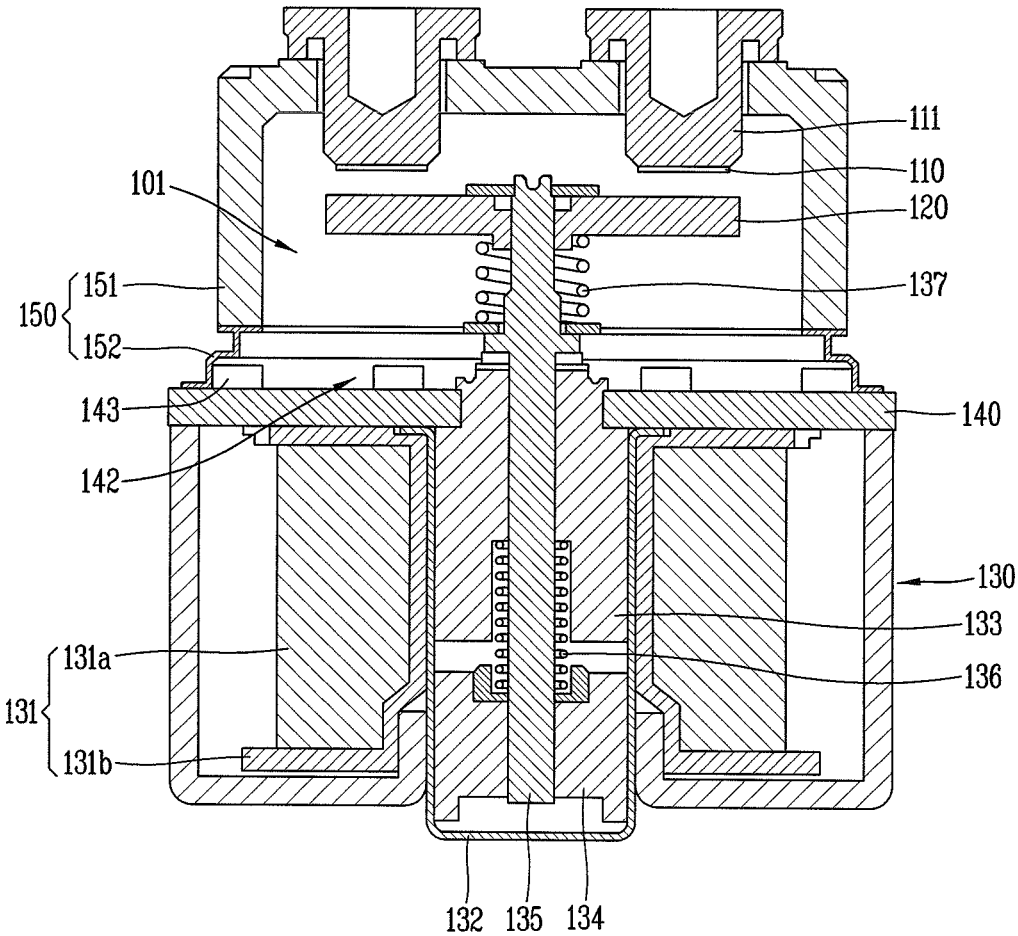
FIG. 1 is a sectional view of a relay for an electric vehicle according to one embodiment of the present invention.
Figure 2:
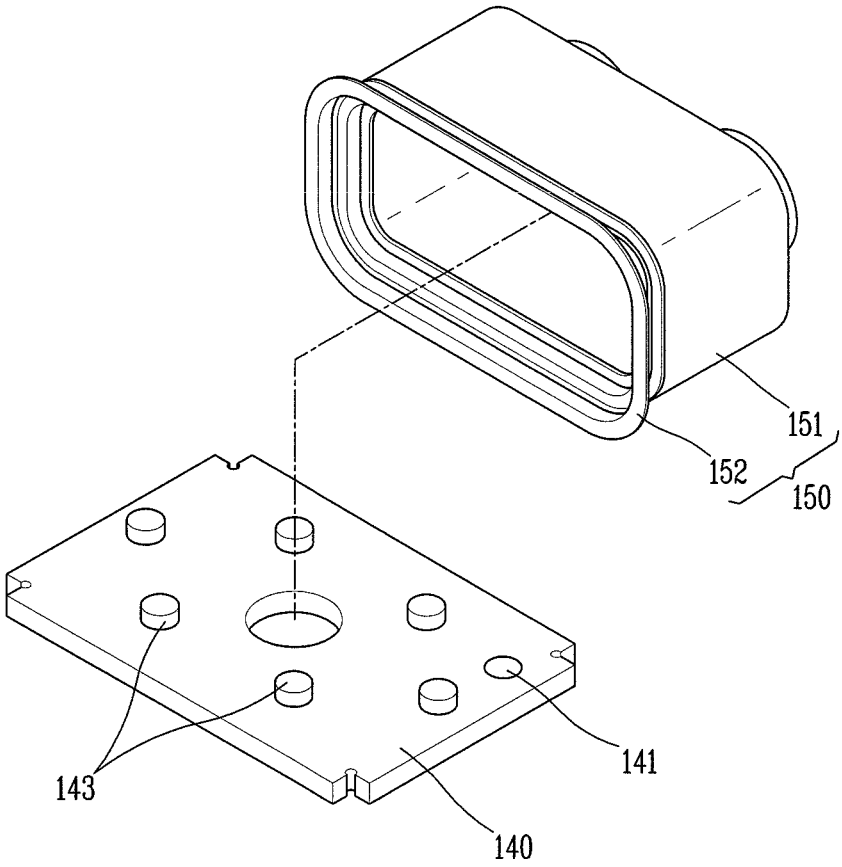
FIG. 2 is an exploded perspective view of a cover assembly and a supporting plate of FIG. 1 according to one embodiment of the present invention.

FIG. 1 is a sectional view of a relay for an electric vehicle according to one embodiment of the present invention, and FIG. 2 is an exploded perspective view of a cover assembly and a supporting plate of FIG. 1 according to one embodiment of the present invention.

Referring to FIGS. 1 and 2, a relay for an electric vehicle according to the present invention is installed between a battery (not shown) for providing an electric power of an electric vehicle, and an inverter for converting a direct current (DC) of the battery into an alternating current (AC) for driving an AC motor. The relay for an electric vehicle serves to supply the electric power from the battery to the inverter, or to break the electric power being supplied to the inverter. The relay for an electric vehicle according to the present invention comprises a fixed contact 110, a movable contact 120, an actuator 130, a supporting plate 140 and a cover assembly 150.

The fixed contact 110 is accommodated in the cover assembly 150, and is supported by the cover assembly 150. The fixed contact 110 formed of an electrically-conducive material is attached to a fixed terminal 111 formed of an electrically-conductive material, thereby being electrically connected to the fixed terminal 111. One end of the fixed terminal 111 to which the fixed contact 110 is attached is extending to inside of the cover assembly 150, and another end of the fixed terminal 111 is fixedly-installed at the cover assembly 150 so as to be protruding to outside through the cover assembly. The fixed contact 110 may be formed in plurality in number.

The movable contact 120 is movable to contact or to be separated from the fixed contact 110. When the fixed contact 110 is formed in plurality in number, the movable contact 120 is also formed in plurality in correspondence to the number of the fixed contacts. In this case, the movable contacts 120 may be arranged to face the fixed contacts 110, respectively.

The actuator 130 serves to drive the movable contact 120, thereby contacting the movable contact 120 to the fixed contact 110 or separating the movable contact 120 from the fixed contact 110. That is, the actuator 130 contacts the movable contact 120 to the fixed contact 110, thereby implementing an electrically-connected state between the movable contact 120 and the fixed contact 110. Alternatively, the actuator 130 may separate the movable contact 120 from the fixed contact 110, thereby implementing an electrically-broken state between the movable contact 120 and the fixed contact 110.

The supporting plate 140 serves to support the actuator 130. The supporting plate 140 may be fixedly-connected to the cover assembly 150 by welding, and may be formed of a metallic material.

The cover assembly 150 is configured to support the fixed contact 110, and is fixed onto the supporting plate 140 by welding, etc. so as to form an arc extinguishing chamber 101 which accommodates therein the fixed contact 110 and the movable contact 120. The cover assembly 150 has an inner space and one open side. More concretely, the cover assembly 150 is formed to have an upside down cup shape. As the supporting plate 140 is fixed to the cover assembly 150 so as to shield the open side of the cover assembly 150, the inner space of the cover assembly 150 may serve as the arc extinguishing chamber 101. Referring to FIG. 2, the supporting plate 140 may be provided with a vent 141 for filling the arc extinguishing chamber 101 with arc extinguishing gas. The vent 141 may be installed with a pipe for filling, and is sealed after arc extinguishing gas is filled in the arc extinguishing chamber 101.

The supporting plate 140 comprises a position guiding portion 142 protruding from an upper surface of the supporting plate 140 that guides the cover assembly 150 to be located on a predetermined position of the supporting plate 140 and maintains the assembled position of the cover assembly 150 and the supporting plate 140 when assembling the cover assembly 150 and the supporting plate 140 to each other, and so as to maintain an assembled position. The cover assembly 150 needs to be fixed onto the supporting plate 140 after being aligned on a predetermined position of the supporting plate 140. The position guiding portion 142 guides a precise assembly position of the cover assembly 150 on the supporting plate 140, thereby enhancing an assembly productivity.

Under a state that the cover assembly 150 has been aligned to be assembled onto the supporting plate 140, the position guiding portion 142 may prevent the cover assembly 150 from being moved (e.g., from being undesirably rotated), and may maintain an aligned state of the cover assembly 150 on the supporting plate 140. This may prevent displacement of the cover assembly 150 before the cover assembly 150 is welded to the supporting plate 140. Accordingly, an excellent welding quality may be obtained when the cover assembly 150 is welded to the supporting plate 140. Besides, since the cover assembly 150 maintains a precise assembly position on the supporting plate 140, a welding operation may be rapidly performed. This may enhance the welding efficiency. Furthermore, since the cover assembly 150 is welded to the supporting plate 140 on a precise position, a horizontal position deviation may not occur between the fixed contact 110 and the movable contact 120. This may implement a relay for an electric vehicle having an excellent quality.

The cover assembly 150 may comprise a ceramic cover 151 and a metal connecting member 152. The ceramic cover 151 is formed of a ceramic material having an electrically-insulated property. One side of the metal connecting member 152 is attached to an end of the ceramic cover 151, and another side thereof is fixedly-connected to the supporting plate 140 by welding. In the case that the metal connecting member 152 is welded to the supporting plate 140, the supporting plate 140 is preferably formed of a metallic material.

The metal connecting member 152 may be attached to the ceramic cover 151 by an adhesive such as an epoxy adhesive. The metal connecting member 152 may have a contact surface with the supporting plate 140. As shown in FIG. 1, the contact surface may be formed to be bending toward outside along the circumference of an end of the metal connecting member 152. This may allow the metal connecting member 152 and the supporting plate 140 to be adhered to each other with a sealed state therebetween.

The position guiding portion 142 may be configurated in various manners. For instance, as shown in FIG. 2, the position guiding portion 142 may comprise a plurality of guiding protrusions 143. The plurality of guiding protrusions 143 are protruding from an upper surface of the supporting plate 140 so as to contact an inner wall of the metal connecting member 152, and are spaced from each other. Once the cover assembly 150 is positioned so that an inner wall of the metal connecting member 152 abuts an outer side surface of the guiding protrusions 143, the cover assembly 150 is easily aligned to be assembled to the supporting plate 140. The guiding protrusions 143 may be formed by an embossing processing.

Figure 3:
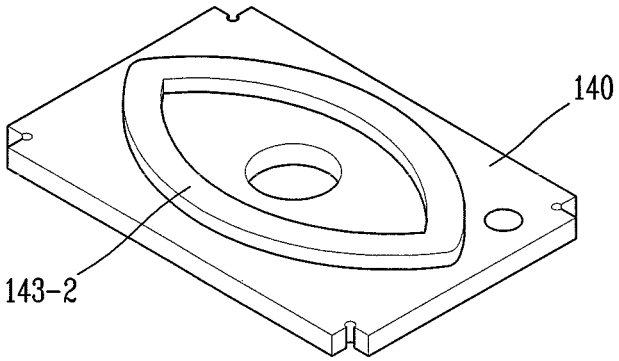
FIG. 3 is a perspective view of a supporting plate according to another embodiment of the present invention.

According to another embodiment, as shown in FIG. 3, the position guiding portion 142 may comprise one ring-shaped guiding protrusion 143-2 protruding from an upper surface of the supporting plate 140 so as to abut an entire surface of an inner wall of the metal connecting member 152.

Figure 4:
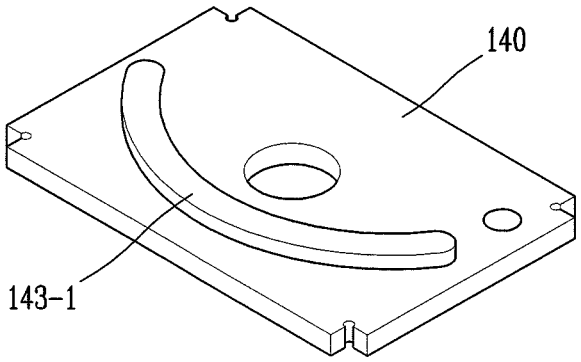
FIG. 4 is a perspective view of a supporting plate according to still another embodiment of the present invention.

According to still another embodiment, as shown in FIG. 4, the position guiding portion 142 may comprise one arc-shaped guiding protrusion 143-1 protruding from an upper surface of the supporting plate 140 so as to abut a part of the inner wall of the metal connecting member 152.

As shown in FIG. 1, the actuator 130 may comprise a coil assembly 131, a cylinder 132, a fixed core 133, a movable core 134, a shaft 135 and a return spring 136.

One side of the coil assembly 131 is fixedly-supported by the supporting plate 140. The coil assembly 131 is provided with a coil 131*a* for generating a magnetic force when a current flows thereon. The coil 131*a* may be wound on a bobbin 131*b*.

The cylinder 132 is installed to penetrate through a central region of the coil assembly 131. One side of the cylinder 132 is fixed to the supporting plate 140 by welding, for instance.

The fixed core 133 is fixedly-accommodated in the cylinder 132. One end of the fixing core 133 may be fixedly-fitted into a central hole (reference numeral not given, refer to FIG. 2) of the supporting plate 140.

The movable core 134 is accommodated in the cylinder 132, and is movable to contact or to be separated from the fixed core 133 while sliding along an inner wall of the cylinder 132.

The shaft 135 is formed to penetrate through the fixed core 133, and is disposed to slide along an inner wall of the fixed core 133. The shaft 135 is movable together with the movable core 134 as one end thereof is coupled to the movable core 134. Another end of the shaft 135 is connected to the movable contact 120. The shaft 135 may be coupled to the movable contact 120 so as to perform a relative motion with respect to the movable contact 120 by penetrating through a central region of the movable contact 120. A contact spring 137 may be installed between the shaft 135 and the movable contact 120.

The contact spring 137 provides an elastic force in a direction to approach the movable contact 120 to the fixed contact 110, and allows the movable contact 120 and the fixed contact 110 to maintain a contacted state with a pressure not less than a predetermined value. The contact spring 137 may be implemented as a compression coil spring.

The return spring 136 is installed between the movable core 134 and the fixed core 133. The return spring 136 provides an elastic force to the movable core 134 in a direction to separate the movable core 134 from the fixed core 133. Once a magnetic force is generated from the coil 131*a* as a current is applied to the coil 131*a* according to a control signal from a control unit (not shown), the movable core 134 moves to contact the fixed core 133. If a control signal is not generated from the control unit, no current is applied to the coil 131*a*. This may cause the movable core 134 to return to the initial position (original position) separated from the fixed core 133 shown in FIG. 1, by an elastic force of the return spring 136. The return spring 136 may be implemented as a compression coil spring.

The operation of the actuator 130 will be explained as follows. Once a current is applied to the coil 131*a* according to a control signal from the control unit (not shown), a magnetic force is generated around the coil 131*a*. Then, the movable core 134 moves to contact the fixed core 133, and the shaft 135 moves to the same direction as the movable core 134. As a result, the movable contact 120 supported by the shaft 135 also moves to the same direction as the shaft 135, thereby contacting the fixed contact 110. As the two fixed terminals 111, the two movable contacts 120 and the two fixed contacts 110 form a closed circuit, a battery side (not shown) and an inverter side (not shown) respectively connected to the two fixed terminals 111 are electrically connected to each other.

Once no current is applied to the coil 131*a* as the control signal is not supplied to the coil 131*a* any longer, the movable core 134 returns to the original position by an elastic force of the return spring 136. As a result, the shaft 135 returns to the original position together with the movable core 134. This may cause the movable contact 120 to be separated from the fixed contact 110. Accordingly, the closed circuit formed by the two fixed terminals 111, the two movable contacts 120 and the two fixed contacts 110 are open, and the battery side (not shown) and the inverter side (not shown) connected to the two fixed terminals 111 respectively are electrically disconnected from each other.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A relay for an electric vehicle, the relay comprising:

a fixed contact;

a movable contact configured to be movable to contact the fixed contact or separate from the fixed contact;

an actuator configured to drive the movable contact to cause the movable contact to contact the fixed contact or separate from the fixed contact;

a supporting plate configured to support the actuator; and a cover assembly configured to support the fixed contact and fixed on the supporting plate to form an arc extinguishing chamber in which the fixed contact and the movable contact are positioned, wherein the supporting plate has a position guiding portion protruding from an upper surface of the supporting plate, the position guiding portion guiding the cover assembly to be located on a predetermined position of the supporting plate and maintaining an assembled position of the cover assembly and the supporting plate wherein the cover assembly comprises:

a ceramic cover; and a metal connecting member attached to an end of the ceramic cover and fixedly-connected to the supporting plate, wherein the position guiding portion comprises a plurality of guiding protrusions spaced from each other and protruding from an upper surface of the supporting plate to contact an inner wall of the metal connecting member.

2. A relay for an electric vehicle, the relay comprising:

a fixed contact;

a movable contact configured to be movable to contact the fixed contact or separate from the fixed contact;

an actuator configured to drive the movable contact to cause the movable contact to contact the fixed contact or separate from the fixed contact;

a supporting plate configured to support the actuator; and a cover assembly configured to support the fixed contact and fixed on the supporting plate to form an arc extinguishing chamber in which the fixed contact and the movable contact are positioned, wherein the supporting plate has a position guiding portion protruding from an upper surface of the supporting plate, the position guiding portion guiding the cover assembly to be located on a predetermined position of the supporting plate and maintaining an assembled position of the cover assembly and the supporting plate, wherein the cover assembly comprises:

a ceramic cover; and a metal connecting member attached to an end of the ceramic cover and fixedly-connected to the supporting plate, wherein the position guiding portion comprises one ring-shaped guiding protrusion protruding from an upper surface of the supporting plate to abut an entire surface of an inner wall of the metal connecting member.

3. A relay for an electric vehicle, the relay comprising:

a fixed contact;

a movable contact configured to be movable to contact the fixed contact or separate from the fixed contact;

an actuator configured to drive the movable contact to cause the movable contact to contact the fixed contact or separate from the fixed contact;

a supporting plate configured to support the actuator; and a cover assembly configured to support the fixed contact and fixed on the supporting plate to form an arc extinguishing chamber in which the fixed contact and the movable contact are positioned, wherein the supporting plate has a position guiding portion protruding from an upper surface of the supporting plate, the position guiding portion guiding the cover assembly to be located on a predetermined position of the supporting plate and maintaining an assembled position of the cover assembly and the supporting plate, wherein the cover assembly comprises:

a ceramic cover; and a metal connecting member attached to an end of the ceramic cover and fixedly-connected to the supporting plate, wherein the position guiding portion comprises one arc-shaped guiding protrusion protruding from an upper surface of the supporting plate to abut a part of an inner wall of the metal connecting member.

4. The relay for an electric vehicle according to claim 1, wherein the actuator comprises:

a coil assembly supported by the supporting plate and having a coil for generating a magnetic force when a current flows thereon;

a cylinder installed configured to penetrate through a central region of the coil assembly and fixed to the supporting plate;

a fixed core fixedly-accommodated in the cylinder;

a movable core accommodated in the cylinder so as and configured to be movable to contact the fixed core or separate from the fixed core;

a shaft penetrating through the fixed core, having one end coupled to the movable core to be movable together with the movable core, and having another end connected to the movable contact; and a return spring configured to provide an elastic force to the movable core in a direction to separate the movable core from the fixed core.

5. The relay for an electric vehicle according to claim 3, wherein the actuator comprises:

a coil assembly supported by the supporting plate and having a coil for generating a magnetic force when a current flows thereon;

a cylinder configured to penetrate through a central region of the coil assembly and fixed to the supporting plate;

a fixed core fixedly-accommodated in the cylinder;

a movable core accommodated in the cylinder so as and configured to be movable to contact the fixed core or separate from the fixed core;

a shaft penetrating through the fixed core, having one end coupled to the movable core to be movable together with the movable core, and having another end connected to the movable contact; and a return spring configured to provide an elastic force to the movable core in a direction to separate the movable core from the fixed core.

6. The relay for an electric vehicle according to claim 2, wherein the actuator comprises:

a coil assembly supported by the supporting plate and having a coil for generating a magnetic force when a current flows thereon;

a cylinder configured to penetrate through a central region of the coil assembly and fixed to the supporting plate;

a fixed core fixedly-accommodated in the cylinder;

a movable core accommodated in the cylinder and configured to be movable to contact the fixed core or separate from the fixed core;

a shaft penetrating through the fixed core, having one end coupled to the movable core to be movable together with the movable core, and having another end connected to the movable contact; and a return spring configured to provide an elastic force to the movable core in a direction to separate the movable core from the fixed core.

* * * * *